US009678452B2

(12) United States Patent
Watanabe et al.

(10) Patent No.: US 9,678,452 B2
(45) Date of Patent: Jun. 13, 2017

(54) ROLLER FOR ELECTROPHOTOGRAPHY, PROCESS CARTRIDGE, AND IMAGE-FORMING APPARATUS

(71) Applicant: CANON KABUSHIKI KAISHA, Tokyo (JP)

(72) Inventors: Masahiro Watanabe, Mishima (JP); Tomohito Taniguchi, Suntou-gun (JP); Noboru Miyagawa, Suntou-gun (JP); Taichi Sato, Numazu (JP); Takehiko Aoyama, Suntou-gun (JP); Takeshi Yoshidome, Kitakyushu (JP); Atsushi Uematsu, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/082,998

(22) Filed: Mar. 28, 2016

(65) Prior Publication Data

US 2016/0291497 A1 Oct. 6, 2016

(30) Foreign Application Priority Data

Apr. 3, 2015 (JP) ..... 2015-077015
Apr. 3, 2015 (JP) ..... 2015-077053
Jul. 3, 2015 (JP) ..... 2015-134770

(51) Int. Cl.
*G03G 15/02* (2006.01)

(52) U.S. Cl.
CPC ..... *G03G 15/0233* (2013.01)

(58) Field of Classification Search
USPC ..... 399/168, 174, 176, 265, 279, 286; 492/30, 56
See application file for complete search history.

(56) References Cited

U.S. PATENT DOCUMENTS 7,462,146 B2 * 12/2008 Nagata ..... B29C 35/02 492/30
8,532,535 B2 * 9/2013 Nose ..... G03G 15/0233 399/176
8,660,472 B2 * 2/2014 Kurachi ..... G03G 15/0818 399/286
2010/0267537 A1 10/2010 Kashihara
2011/0305481 A1 12/2011 Taniguchi
2014/0301754 A1 10/2014 Uematsu

FOREIGN PATENT DOCUMENTS

EP 0636949 A2 2/1995
EP 1355201 A1 10/2003
JP 2001-254725 A 9/2001
JP 2005-128144 A 5/2005
JP 2008-275656 A 11/2008
JP 04799706 B1 10/2011
JP 2011-237470 A 11/2011
JP 2012-103414 A 5/2012

* cited by examiner

*Primary Examiner* — Hoan Tran
(74) *Attorney, Agent, or Firm* — Canon U.S.A. Inc., IP Division

(57) ABSTRACT

A roller for electrophotography including a mandrel and an elastic layer on the mandrel is provided. The elastic layer contains a hollow particle in a region from the surface of the elastic layer to a depth of 100 μm. A cross-section of the hollow particle intersected by a first plane and a cross-section of the hollow particle intersected by a second plane each have a ratio of the length of the long axis to the length of the short axis of 1.2 or more and 1.9 or less.

10 Claims, 6 Drawing Sheets

ROLLER FOR ELECTROPHOTOGRAPHY, PROCESS CARTRIDGE, AND IMAGE-FORMING APPARATUS

BACKGROUND OF THE INVENTION

Field of the Invention

The present invention relates to a roller for electrophotography to be used in an electrophotographic image-forming apparatus (hereinafter, also simply referred to as "image-forming apparatus"), such as a copier or printer employing an electrophotographic system.

Description of the Related Art

An image-forming apparatus employing an electrophotographic system is mainly composed of an electrophotographic photosensitive member, a charging device, an exposure device, a developing device, a transfer device, and a fixing device.

Many charging devices employ a system of charging the surface of a photosensitive member by applying a voltage to a charging roller being in contact with or disposed in proximity to the surface of the photosensitive member. The charging roller being in contact with the surface of the photosensitive member and charging the photosensitive member is rotated following the photosensitive member.

Stabilization of the driven rotation of the charging roller needs a sufficient nip width between the charging roller and the electrophotographic photosensitive member. The nip width between the charging roller and the photosensitive member can be secured by reducing the hardness of the charging roller. Japanese Patent Laid-Open No. 2008-275656 discloses a method of reducing the hardness of a charging roller with a conductive foamed elastic layer. Japanese Patent Laid-Open No. 2001-254725 discloses a method for achieving a desired hardness by adding organic microballoons to an elastomer layer of a semiconductive roller.

SUMMARY OF THE INVENTION

The present invention is directed to providing a roller for electrophotography forming images while preventing horizontal streaks due to stick-slip from occurring. The present invention is also directed to providing a process cartridge and an image-forming apparatus that can form high-quality electrophotographic images.

According to one aspect of the present invention, there is provided a roller for electrophotography, comprising: a mandrel; and an elastic layer on the peripheral surface of the mandrel, wherein the elastic layer contains a hollow particle in a region from a surface of the elastic layer to a depth of 100 μm, the hollow particle satisfying the following conditions (i) and (ii):

(i) when the roller for electrophotography is intersected by a first plane perpendicular to an axial direction of the mandrel and passing through a point inside of the hollow particle, the point corresponding to, when assuming that the hollow particle is a solid particle, a centroid of the solid particle, the hollow particle has a flat cross-sectional shape having a long axis and a short axis, and a line along the long axis is perpendicular to a line passing through the point of the hollow particle and a rotation center of the mandrel in the first plane, (ii) when the roller for electrophotography is intersected by a second plane containing the axis of the mandrel and passing through the point of the hollow particle, the hollow particle has a flat cross-sectional shape having a long axis and a short axis, and a line along the long axis is perpendicular to a line passing through the point of the hollow particle and perpendicular to the axis of the mandrel;

the cross-section of the hollow particle intersected by the first plane has a ratio of the length of the long axis to the length of the short axis of 1.2 or more and 1.9 or less; and the cross-section of the hollow particle intersected by the second plane has a ratio of the length of the long axis to the length of the short axis of 1.2 or more and 1.9 or less.

Another aspect of the present invention provides a process cartridge that is detachable from an image-forming apparatus and includes the above-described roller for electrophotography.

Another aspect of the present invention provides an image-forming apparatus including the above-described roller for electrophotography.

Further features of the present invention will become apparent from the following description of exemplary embodiments with reference to the attached drawings.

DESCRIPTION OF THE EMBODIMENTS

Recently, image-forming apparatuses are demanded to increase the speed, and in high speed driving, vibration from members in contact with the roller for electrophotography is increased. The present inventors used each of the rollers described in Japanese Patent Laid-Open Nos. 2008-275656 and 2001-254725 as the charging roller of a high-speed apparatus. The use demonstrated that the charging roller being in contact with the electrophotographic photosensitive member vibrates by the vibration of the photosensitive member to readily cause a phenomenon called stick-slip. The stick-slip is a phenomenon of irregular occurrence of a difference between the peripheral speeds of the charging roller and the electrophotographic photosensitive member during the driven rotation, as a result of a decrease of the driven rotation properties of the charging roller by the photosensitive member. Occurrence of the stick-slip leads to occurrence of horizontal streaks in images. That is, horizontal streaks resulting from stick-slip, which have not occurred before, but may become apparent in images with an increase in the speed of an image-forming apparatus. The present inventors have become aware of the fact that the prevention of horizontal steaks is necessary for more stably forming images, have found that a roller for electrophotography according to one embodiment of the present disclosure can prevent the occurrence of the horizontal streaks in images resulting from the stick-slip.

The present invention will now be described in detail in accordance with preferred embodiments.

<Roller for Electrophotography>

Figure 1A:
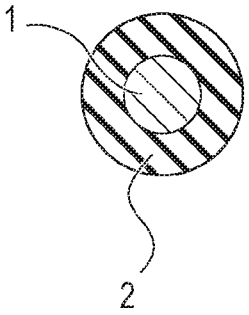
FIGS. 1A and 1B are each a schematic cross-sectional view of an exemplary roller for electrophotography according to an embodiment of the present invention.
Figure 1B:
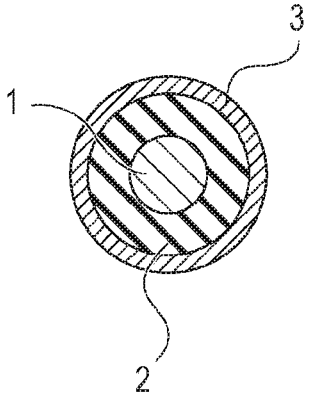

FIGS. 1A and 1B are each a schematic cross-sectional view of an exemplary roller for electrophotography according to an embodiment of the present invention. As shown in FIG. 1A, the roller for electrophotography is composed of a conductive mandrel 1 and an elastic layer 2 covering the surface (peripheral surface) of the mandrel 1. Alternatively, as shown in FIG. 1B, the mandrel 1 may be covered with a two-layer structure consisting of the elastic layer 2 and a surface layer 3 further disposed on the surface of the elastic layer 2. The roller can further include an adhesive layer between the layers.

(Mandrel)

The mandrel 1 can have conductivity for supplying electricity to the surface of the roller for electrophotography through the mandrel 1. The mandrel 1 can have an electric resistance value lower than that of a conductive layer and can have a volume resistivity of $10^3$ Ω·cm or less. The conductive mandrel 1 can be appropriately selected from those known in the field of roller for electrophotography. For example, a columnar solid mandrel 1 made of a carbon steel alloy and having a surface plated with nickel to a thickness of about 5 μm can be used.

(Elastic Layer)

The elastic layer contains a hollow particle in a region from a surface of the elastic layer to a depth of 100 μm. The hollow particle satisfies the following conditions (i) and (ii):

(i) when the roller for electrophotography is intersected by a first plane passing through a point inside of the hollow particle, the point corresponding to, when assuming that the hollow particle is a solid particle, a centroid of the solid particle, in the direction perpendicular to the axial direction (longitudinal direction) of the mandrel 1, the hollow particle has a flat cross-sectional shape having a long axis and a short axis in the first plane, and a line passing through the point of the hollow particle and the rotation center of the mandrel in the first plane and a line extending in the long axis direction have an intersection point; and (ii) when the roller for electrophotography is intersected by a second plane containing the axis of the mandrel 1 and passing through the point of the hollow particle, the hollow particle has a flat cross-sectional shape having a long axis and a short axis in the second plane, and a line passing through the point of the hollow particle and perpendicular to the axis of the mandrel 1 and a line along the long axis have an intersection point.

Figure 2A:
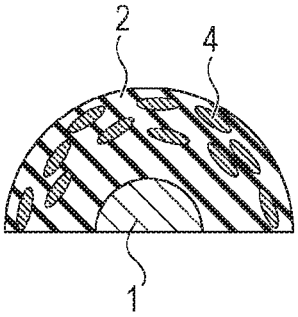
FIGS. 2A and 2B are schematic cross-sectional views of an exemplary elastic layer of a roller for electrophotography according to an embodiment of the present invention.
Figure 2B:
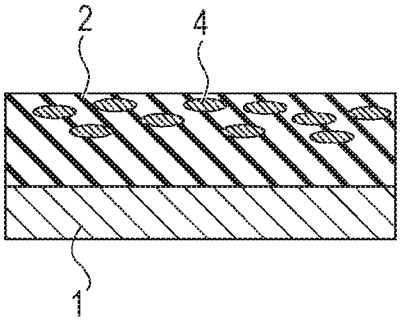

FIGS. 2A and 2B are schematic cross-sectional views of an exemplary elastic layer of a roller for electrophotography according to an embodiment of the present invention. FIG. 2A illustrates a cross-section of the roller for electrophotography intersected by a plane perpendicular to the axial direction, i.e. longitudinal direction, of the mandrel 1. FIG. 2B illustrates a cross-section of the roller for electrophotography in the axial direction, i.e. longitudinal direction. In FIGS. 2A and 2B, flat hollow particles 4 satisfying the conditions (i) and (ii) are disposed in the elastic layer 2 in a region from the surface of the elastic layer 2 to a depth of 100 μm.

Figure 3A:
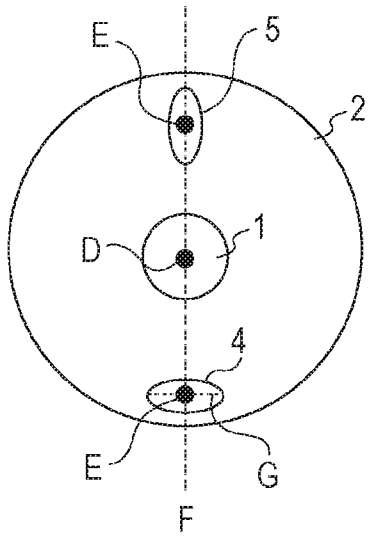
FIGS. 3A and 3B are diagrams explaining intersection points of lines.
Figure 3B:
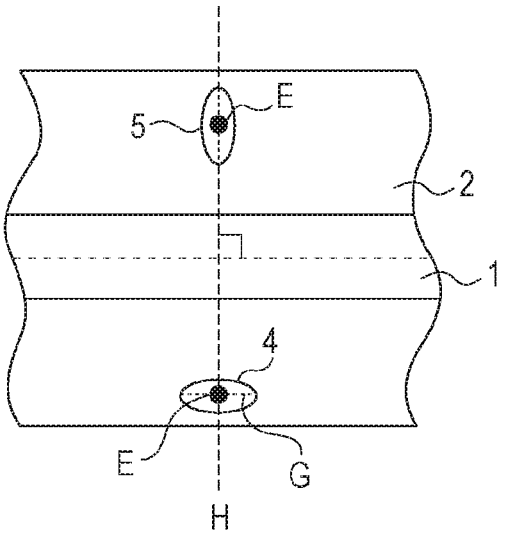

The flat hollow particles 4 satisfying the conditions (i) and (ii) will be described with reference to FIGS. 3A and 3B. FIG. 3A illustrates a cross-section of the roller for electrophotography intersected by a first plane perpendicular to the axial direction, i.e. longitudinal direction, of the mandrel 1 and passing through a point inside of the hollow particle. The point corresponds to, when assuming that the hollow particle is a solid particle, a centroid of the solid particle. FIG. 3B illustrates a cross-section of the roller for electrophotography intersected by a second plane containing the axis of the mandrel 1 and passing through the point of the hollow particle.

In FIGS. 3A and 3B, the hollow particles 4 are flat hollow particles satisfying the conditions (i) and (ii). In the first plane, the line F passing through the rotation center D of the mandrel 1 and the point E of the flat hollow particle 4 and the line G extending in the long axis direction of the flat hollow particle 4 have an intersection point. In the second plane, the line H passing through the point E of the flat hollow particle 4 and perpendicular to the axis of the mandrel 1 and the line G extending in the long axis direction of the flat hollow particle 4 have an intersection point. In contrast, a hollow particle 5 does not satisfy the conditions (i) and (ii). In the first plane, the direction of the line F passing through the rotation center D of the mandrel 1 and the point E of the hollow particle 5, and the direction of a line extending in the long axis direction of the hollow particle 5 are the same and do not have an intersection point. Similarly, in the second plane, the direction of the line H passing through the point E of the hollow particle 5 and perpendicular to the axis of the mandrel 1, and the direction of a line extending in the long axis direction of the hollow particle 5 are the same and do not have an intersection point.

Throughout the specification, the term "long axis" of a hollow particle in each plane refers to the longest line segment among the line segments passing through the point of the hollow particle and connecting two points on the line defining the void of the hollow particle in the plane. The term "length of the long axis" refers to the length of such a line segment. The term "short axis" of a hollow particle in each plane refers to the shortest line segment among the line segments passing through the point of the hollow particle and connecting two points on the line defining the void of the hollow particle in the plane. The term "length of the short axis" refers to the length of such a line segment.

The present inventors presume the reasons that the roller for electrophotography including the elastic layer having such a structure can reduce the vibration from other members and prevents stick-slip as follows.

Figure 4A:
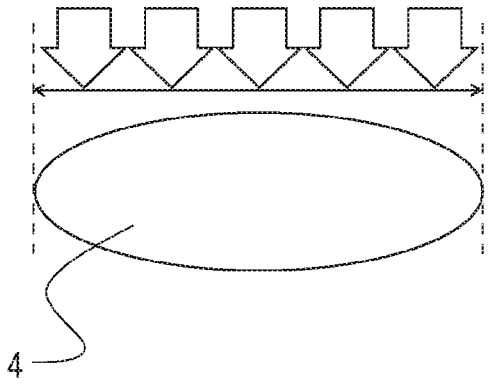
FIGS. 4A and 4B are diagrams explaining deformation of a flat hollow particle.
Figure 4B:
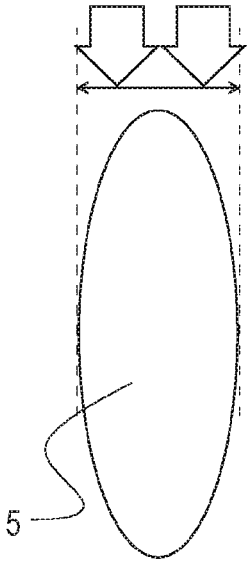

When the roller for electrophotography is in contact with another member, the hollow particles contained in the elastic layer are deformed due to the pressure by the contact. FIGS. 4A and 4B are diagrams explaining the deformation of flat hollow particle. FIG. 4A shows the pressure received by a flat hollow particle when the flat hollow particle is compressed by the pressure applied from the direction perpendicular to the long axis, and FIG. 4B shows the pressure received by a flat hollow particle when the flat hollow particle is compressed by the pressure applied from the long axis direction. As shown in FIGS. 4A and 4B, the pressure is applied to a broader area of a flat hollow particle in the case of receiving the pressure from the direction perpendicular to the long axis (FIG. 4A) compared to the case of receiving the pressure from the long axis direction (FIG. 4B). That is, a flat hollow particle receives a larger pressure when applied from the direction perpendicular to the long axis and is therefore apt to deform. Since a larger deformation of the hollow particle accelerates the conversion of vibrational energy to elastic deformation or thermal energy, the vibration promptly attenuates. Accordingly, a flat hollow particle efficiently prevents vibration when a pressure is applied from the direction perpendicular to the long axis than when a pressure is applied from the long axis direction.

In a hollow particle satisfying the condition (i), the long axis of the hollow particle tilts relative to the line F passing through the rotation center of the mandrel 1 and the point of the hollow particle and extending to the surface of the elastic layer 2. Accordingly, when a member is brought into contact with the surface of the elastic layer 2, the hollow particle is not compressed from the long axis direction in the first plane side. Similarly, in a hollow particle satisfying the condition (ii), the long axis of the hollow particle tilts relative to the line H perpendicular to the axis of the mandrel 1, passing through the point of the hollow particle, and extending to the surface of the elastic layer 2. Accordingly, when a member is brought into contact with the surface of the elastic layer 2, the hollow particle is not compressed from the long axis direction in the second plane side. Consequently, the flat hollow particle 4 satisfying the conditions (i) and (ii) has an effect of highly preventing vibration.

The flat hollow particle 4 satisfying the conditions (i) and (ii) is flat in both the first and second planes and is therefore prevented from vibrating by itself. In flat hollow particles, as described above, since the amounts of deformation on the long axis side and the short axis side are different from each other, the frequencies of the vibration on the long axis side and the short axis side are different from each other. If anisotropy in the frequency of vibration occurs in a single hollow particle, vibration transmitted from one direction of the hollow particle hardly spreads to another direction in the hollow particle, resulting in prevention of vibration of the entire hollow particle. As a result, the vibration attenuates in the hollow particle to prevent the vibration applied to one hollow particle from spreading to another particle or resin in the elastic layer. In contrast, in spherical hollow particles, since anisotropy in the frequency of vibration does not occur in one hollow particle, vibration transmitted from one direction of the hollow particle readily spreads to another direction in the hollow particle, leading to vibration of the entire hollow particle. The vibration of the hollow particle does not attenuate in the hollow particle and spreads to adjacent spherical hollow particles via a binder. The vibration is thus hardly prevented.

Whether a hollow particle satisfies the conditions (i) and (ii) or not can be determined as follows. An elastic layer is three-dimensionally measured with a three-dimensional transmission electron microscope or an X-ray CT. A 3D-CAD solid model is generated from the data of the resulting three-dimensional image. Subsequently, the elastic layer is equally divided in ten in the axis direction (longitudinal direction). In each region of the resulting ten regions, a region of a 5 mm square at a depth of 100 μm from the surface of the elastic layer is selected at each of four points (0°, 90°, 180°, and 270°) in the circumferential direction. With respect to the hollow particle present in each of the regions, in the case that the hollow particles are assumed to be solid particles, the weight centroid of each of the solid particles is calculated from 3D-CAD. Two-dimensional images of the first plane and the second plane are cut out such that the planes pass through points of the hollow particles, the point corresponding to the centroids of the assumed solid particles. In the resulting first plane, whether the cross-section of the hollow particle is a flat shape having a long axis and a short axis or not and whether a line passing through the rotation center of the mandrel 1 and the point and a line extending in the long axis direction have an intersection point or not, i.e. whether the condition (i) is satisfied or not, are verified. In the second plane, whether the hollow particle has a flat shape having a long axis and a short axis or not and whether a line passing through the point and perpendicular to the axis of the mandrel 1 and a line extending in the long axis direction have an intersection point or not (whether the condition (ii) is satisfied or not) are verified.

The ratio of the length of the long axis to the length of the short axis, i.e. the length of the long axis/the length of the short axis. of the hollow particle in the first plane and the ratio of the length of the long axis to the length of the short axis, i.e. the length of the long axis/the length of the short axis, of the hollow particle in the second plane are each 1.2 or more and 1.9 or less. A hollow particle having a ratio, the length of the long axis/the length of the short axis, of 1.2 or more is sufficiently flat and is highly effective for preventing vibration. In addition, since the effect of preventing vibration increases with an increase in anisotropy of the shape of the hollow particle, the ratio, the length of the long axis/the length of the short axis, is preferably 1.3 or more and 1.9 or less and more preferably 1.5 or more and 1.9 or less.

The ratio of the length of the long axis to the length of the short axis, i.e. the length of the long axis/the length of the short axis, of a hollow particle is the arithmetic mean of ratios, the length of the long axis/the length of the short axis, of all flat hollow particles 4 satisfying the conditions (i) and (ii) in all the regions mentioned above. The length of the long axis and the length of the short axis of each flat hollow particle 4 in each region can be determined from 3D-CAD.

The flat hollow particle 4 can have a size such that the length of the short axis is 10 μm or more and 130 μm or less, in particular, 20 μm or more and 50 μm or less, in the first plane and the second plane. A flat hollow particle 4 having a size in this range can secure a uniform nip between the roller for electrophotography and another member being in contact with each other.

Figure 5:
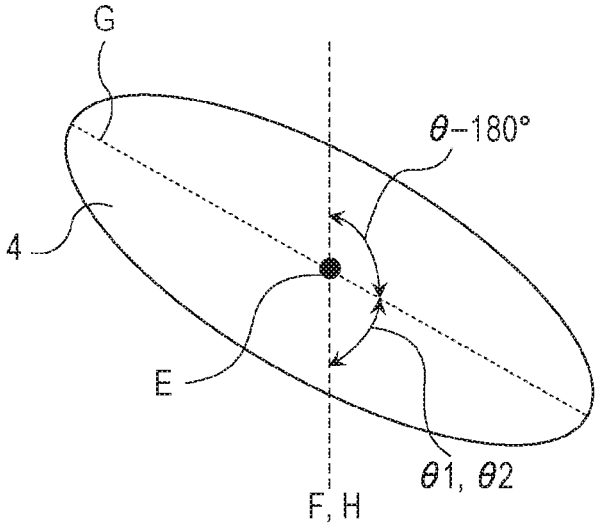
FIG. 5 is a diagram explaining an intersection angle of a flat hollow particle.

In the first plane, the slope θ1 of the line G extending in the long axis direction of a flat hollow particle 4 with respect to the line F passing through the rotation center D of the mandrel 1 and the point E of the flat hollow particle 4 can be 45° or more and 90° or less. In the second plane, the slope θ2 of the line G extending in the long axis direction of a flat hollow particle 4 with respect to the line H passing through the point of the flat hollow particle 4 and perpendicular to the axis of the mandrel 1 can be 45° or more and 90° or less. The slopes θ1 and θ2 are each preferably 60° or more and 90° or less. When both slopes θ1 and θ2 are 45° or more and 90° or less, since the flat hollow particle 4 is compressed from a direction that is closer to the short axis direction than the long axis direction, the effect of attenuating vibration is high. The angles of the slopes θ1 and θ2 are each, as shown in FIG. 5, the intersection angle of 90° or less among the intersection angles formed by two intersecting lines.

The content of the flat hollow particles 4 can be appropriately adjusted depending on the desired coefficient of elasticity and the hardness. An increase in the content of the flat hollow particles 4 increases the coefficient of elasticity to further enhance the effect of preventing vibration, but decreases the hardness of the roller for electrophotography.

Accordingly, for example, in a case of using the roller for electrophotography as a charging roller, the number of the flat hollow particles 4 per unit volume (100×100×100 μm) in a region from the surface of the elastic layer 2 to a depth of 100 μm can be 5 or more and 150 or less.

The region from the surface of the elastic layer 2 to a depth of 100 μm may contain hollow particles not satisfying the conditions (i) and (ii).

Although the region deeper than the region from the surface of the elastic layer 2 to a depth of 100 μm may contain hollow particles or may not contain hollow particles, an elastic layer containing hollow particles in the deep region can enhance the effect of preventing vibration compared to an elastic layer not containing hollow particles. The hollow particles contained in the region deeper than a depth of 100 μm from the surface may have any shape and may be spherical or flat. That is, the hollow particles contained in the region deeper than a depth of 100 μm from the surface may be flat hollow particles satisfying the conditions (i) and (ii) or may be hollow particles not satisfying the conditions.

The flat hollow particles 4 contained in the region from the surface of the elastic layer 2 to a depth of 100 μm are resin balloons having shells. The resin balloons each form an interface of a shell between the elastic layer and the void and therefore can attenuate the vibrational energy. In addition, the elastic layer forming the void by the resin balloon promptly recovers from the deformation by application of a pressure to the original shape, compared to a foamed elastic layer formed by chemical foaming. That is, even in a high-speed processing machine in which the roller for electrophotography rotates at a high speed, the elastic layer of the roller for electrophotography promptly recovers the original shape after the roller for electrophotography is released from the contact with another member. Accordingly, a sufficient nip width can be stably secured between the roller for electrophotography and other members.

The shell of the flat hollow particle 4 should have a thickness of 0.2 μm or more and 5.0 μm or less in a case of using the roller for electrophotography as a charging roller. When the shell has a thickness within this range, the flat hollow particle 4 can be easily elastically deformed when the roller for electrophotography is brought into contact with another member, leading to a further enhancement of the effect of preventing vibration.

[Hollow Particle]

The resin particle becoming the flat hollow particle 4 satisfying the conditions (i) and (ii) is, for example, a thermally expandable microcapsule. The thermally expandable microcapsule is a resin particle containing, in the inside of the particle, a material, i.e. an internal material, that expands by application of heat for drying, curing, or cross-linking the binder in the elastic layer 2. The thermally expandable microcapsule becomes into a hollow particle having a shell by expansion of the internal material.

It is important to use a thermoplastic resin as the resin constituting the thermally expandable microcapsule, i.e., the material constituting the shell of the flat hollow particle 4. Examples of the thermoplastic resin include acrylonitrile resins, vinyl chloride resins, vinylidene chloride resins, methacrylic acid resins, styrene resins, butadiene resins, urethane resins, amide resins, methacrylonitrile resins, acrylic acid resins, acrylate resins, and methacrylate resins. Among these resins, acrylonitrile resins, vinylidene chloride resins, and methacrylonitrile resins have low gas transmission properties and high impact resilience. Accordingly, the resin can be at least one selected from these thermoplastic resins. These thermoplastic resins can be used alone or in a combination of two or more thereof. Alternatively, copolymers prepared by copolymerization of monomers of these thermoplastic resins may be used.

The resin constituting the thermally expandable microcapsule is usually different from the binder of the elastic layer 2 as described below. When the material constituting the shell is different from the binder of the elastic layer 2, the hardness and the coefficient of elasticity of the shell are also different from those of the binder. Consequently, the vibration received by the elastic layer 2 can be easily attenuated by the shell.

The internal material of the thermally expandable microcapsule can be a material that expands into a gas at a temperature lower than the softening point of the thermoplastic resin. Examples of such a material include low-boiling-point liquids, such as propane, propylene, butene, n-butane, isobutane, n-pentane, and isopentane; and high-boiling-point liquids, such as n-hexane, isohexane, n-heptane, n-octane, isooctane, n-decane, and isodecane.

The thermally expandable microcapsule can be produced by a known method, such as suspension polymerization, interfacial polymerization, interfacial precipitation, or a drying-in-liquid method. In the suspension polymerization, for example, a polymerizable monomer, an internal material, and a polymerization initiator are mixed, and the mixture is dispersed in an aqueous solvent containing a surfactant and a dispersion stabilizer, followed by suspension polymerization. In addition, a compound having a reactive group that reacts with the functional group of the polymerizable monomer or an organic filler may be mixed.

Examples of the polymerizable monomer include acrylonitrile, methacrylonitrile, α-chloracrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylates (methyl acrylate, ethyl acrylate, n-butyl acrylate, isobutyl acrylate, t-butyl acrylate, isobornyl acrylate, cyclohexyl acrylate, and benzyl acrylate), methacrylates (methyl methacrylate, ethyl methacrylate, n-butyl methacrylate, isobutyl methacrylate, t-butyl methacrylate, isobornyl methacrylate, cyclohexyl methacrylate, and benzyl methacrylate), styrene monomers, acrylic amide, substituted acrylic amide, methacrylic amide, substituted methacrylic amide, butadiene, ε-caprolactam, polyether, and isocyanate. These polymerizable monomers may be used alone or in a combination of two or more thereof.

Although any polymerization initiator may be used, an initiator soluble in the polymerizable monomer can be used. Known peroxide initiators and azo initiators, in particular, azo initiators, can be used. Examples of the azo initiators include 2,2'-azobisisobutyronitrile, 1,1'-azobiscyclohexane-1-carbonitrile, and 2,2'-azobis-4-methoxy-2,4-dimethylvaleronitrile. Among them, in particular, 2,2'-azobisisobutyronitrile can be used. The polymerization initiator can be used in an amount of 0.01 to 5 parts by mass based on 100 parts by mass of the polymerizable monomer.

Examples of the surfactant include anionic surfactants, cationic surfactants, nonionic surfactants, amphoteric ionic surfactants, and polymer dispersing agents. The surfactant can be used in an amount of 0.01 to 10 parts by mass based on 100 parts by mass of the polymerizable monomer. Examples of the dispersion stabilizer include organic fine particles (such as polystyrene fine particles, polymethyl methacrylate fine particles, polyacrylic acid fine particles, and polyepoxide fine particles), silica (such as colloidal silica), calcium carbonate, calcium phosphate, aluminum hydroxide, barium carbonate, and magnesium hydroxide.

The dispersion stabilizer can be used in an amount of 0.01 to 20 parts by mass based on 100 parts by mass of the polymerizable monomer.

The suspension polymerization can be performed in a hermetically sealed pressure resistant container. The suspension polymerization may be performed in a pressure resistant container after suspension with, for example, a disperser or after suspension in the pressure resistant container. The polymerization temperature can be 50° C. to 120° C. Although the polymerization may be performed under an atmospheric pressure, in order to prevent vaporization of the material encapsulated in the thermally expandable microcapsule, the polymerization can be performed under increased pressure, in particular, under a pressure of 0.1 to 1 MPa higher than the atmospheric pressure. After completion of polymerization, solid-liquid separation and rinsing may be performed by centrifugation or filtration. In the case of performing solid-liquid separation or rinsing, subsequently, drying or pulverization may be performed at a temperature lower than the softening temperature of the resin constituting the thermally expandable microcapsule. The drying and pulverization can be performed by known methods, and a flash dryer, a fair wind dryer, or a nauta mixer can be used. The drying and pulverization can also be simultaneously performed with a drying pulverizer. The surfactant and the dispersion stabilizer can be removed by repeating rinsing and filtration after the production.

The thermally expandable microcapsule can be used at any content. For example, in a case of using the roller for electrophotography as a charging roller, the content of the microcapsule can be 2% by mass or more and 30% by mass or less. Good image characteristics can be obtained by adjusting the content of the thermally expandable microcapsule to 2% by mass or more and 30% by mass or less.

The thermally expandable microcapsules may have any volume-average particle diameter, and the volume-average particle diameter can be 5 μm or more and 50 μm or less. Production targeting a particle diameter within this range can easily provide thermally expandable microcapsules with a low variation in the amount of the internal material, leading to expansion of the microcapsules at a uniform size in the production of the roller for electrophotography.

[Binder]

The binder constituting the elastic layer 2 can be known rubber. Examples of the rubber include natural rubber, vulcanized natural rubber, and synthetic rubber.

Examples of the synthetic rubber include ethylene propylene rubber, styrene butadiene rubber (SBR), silicone rubber, urethane rubber, isopropylene rubber (IR), butyl rubber, acrylonitrile butadiene rubber (NBR), chloroprene rubber (CR), butadiene rubber (BR), acrylic rubber, epichlorohydrin rubber, and fluororubber. Among these rubbers, in particular, the binder can be NBR or SBR.

[Other Components Constituting Elastic Layer]

In a case of using the roller for electrophotography as a charging roller, the elastic layer 2 can contain a conductive agent to have a desired volume resistivity.

The elastic layer 2 can have a volume resistivity of $1\times10^{2}$ Ωcm or more and $1\times10^{16}$ Ωcm or less in an atmosphere of a temperature of 23° C. and a humidity of 50% RH. In a case of using the roller for electrophotography including the elastic layer 2 having a volume resistivity within this range as a charging roller, appropriate charging of the photosensitive member can be more easily performed by discharging.

In order to express conductivity, the elastic layer 2 may contain a known electronic conductive agent or ionic conductive agent.

Examples of the electronic conductive agent include fine particles or fibers of metals such as aluminum, palladium, iron, copper, and silver; conductive metal oxides, such as titanium oxide, tin oxide, and zinc oxide; composite particles composed of the above-mentioned metal fine particles, metal fibers, or metal oxides subjected to surface treatment, such as electrolytic treatment, spray coating, or mixing/shaking; and powders of carbon, such as furnace black, thermal black, acetylene black, Ketjen black, polyacrylonitrile (PAN) carbon, and Pitch carbon. These electronic conductive agents can be used alone or in a combination of two or more thereof.

Any ionic conductive agent having ionic conduction can be used. Examples of the ionic conductive agent include inorganic ionic materials, such as lithium perchlorate, sodium perchlorate, and calcium perchlorate; cationic surfactants, such as lauryl trimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethylammonium ethosulfate; amphoteric ionic surfactants, such as lauryl betaine, stearyl betaine, and dimethylalkyl lauryl betaine; quaternary ammonium salts, such as tetraethylammonium perchlorate, tetrabutylammonium perchlorate, and trimethyloctadecylammonium perchlorate; and organic acid lithium salts, such as lithium trifluoromethanesulfonate. These ionic conductive agents may be used alone or in a combination of two or more thereof.

The elastic layer 2 may contain, in addition to the components mentioned above, insulating particles and additives, such as a softener and a plasticizer, in order to adjust the hardness. The plasticizer can be of a polymer type preferably having a weight-average molecular weight of 2000 or more and more preferably 4000 or more. The elastic layer 2 may further contain materials that provide various functions, such as an age resistor, a filler, a processing aid, a tackifier, an antitack agent, a dispersant, a roughening particle, and resin particles other than the flat hollow particles 4 described above. Examples of the resin particles other than the flat hollow particles 4 include polymethyl methacrylate particles, polyethylene particles, silicone rubber particles, polyurethane particles, polystyrene particles, amino resin particles, and phenol resin particles.

[Method of Forming Elastic Layer]

An uncured elastic layer is formed on the peripheral surface of the mandrel 1. The uncured elastic layer can be formed on the peripheral surface of the mandrel 1 by, for example, coating the mandrel 1 with a sheet or tube having a prescribed thickness formed in advance or integrally extruding the mandrel 1 and the materials of the elastic layer with an extruder equipped with a crosshead.

Subsequently, the uncured elastic layer thus-coated on the mandrel 1 is heat cured.

The thermally expandable microcapsules expand by the heat associated with the heat curing of the binder. In general, the thermally expandable microcapsules heated under an atmospheric pressure uniformly expand into spherical hollow particles, rather than flat hollow particles.

In order to form an elastic layer 2 containing flat hollow particles 4 satisfying the conditions (i) and (ii), after the heat curing of the binder and the formation of spherical hollow particles, the cured elastic layer can be heat treated again under an atmospheric pressure (hereinafter, referred to as "re-heat treatment"). The re-heat treatment of the heat cured elastic layer causes contraction of the binder and contraction of the spherical hollow particles formed by heat curing to compress the spherical hollow particles into flat shapes.

A presumed mechanism of providing flat hollow particles 4 by re-heat treatment will now be described.

Heating of an uncured elastic layer causes heat curing of the binder and expansion of the thermally expandable microcapsules in a competitive manner. As a result, a heat cured elastic layer containing spherical hollow particles in the heat cured binder is obtained. Subsequently, the heat cured elastic layer is further heated at a higher temperature to cause decomposition and recombination of the binder component. The unrecombined binder component having a low molecular weight volatilizes to cause contraction of the binder.

At the same time, the internal material in the spherical hollow particle starts to transmit to the outside of the hollow particle by further heating. Consequently, the pressure from outside by the contraction of the binder becomes higher than the internal pressure of the spherical hollow particle to cause contraction of the spherical hollow particle.

It has been revealed that the spherical hollow particles are mainly compressed in the thickness direction of the elastic layer. This is probably caused by that the binder mainly contracts in the thickness direction of the elastic layer. Consequently, the slopes θ1 and θ2 of the lines extending in the long axis direction of flat hollow particles 4 are each near 90°.

However, the binder may also contract in the circumferential direction or the longitudinal direction of the roller in some types of the binder. As a result, the slopes θ1 and θ2 may tilt to about 40° or less.

For example, in a roller produced using acrylonitrile butadiene rubber (NBR) or epichlorohydrin rubber as the binder, the dominant contraction direction of the binder when the roller is re-heated is the thickness direction of the elastic layer. As a result, the slopes θ1 and θ2 are both relatively near 90°. In contrast, in a roller produced using styrene butadiene rubber (SBR) as the binder, when the roller is re-heated, the binder contracts in both the circumferential direction and the longitudinal direction of the roller, and the slopes θ1 and θ2 each tilt to a range of 40° to 80°.

The contraction of the binder mainly occurs in the immediate vicinity of the surface of the elastic layer. This is probably caused by that the surface of the elastic layer is exposed to the air and thereby the vicinity of the surface is readily heated. Consequently, in particular, hollow particles present in the vicinity of the surface of the elastic layer, specifically, in the region from the surface of the elastic layer to a depth of 100 μm, are apt to contract.

The conditions for heat curing and for re-heat treatment of the binder can be appropriately adjusted depending on the type of the binder, the type of the vulcanizing agent used for curing the binder, the type of the internal material in the thermally expandable microcapsule, and other factors. For example, when the internal material in the thermally expandable microcapsule is hexane, the binder is NBR or SBR, and the binder is cured with a sulfur-based vulcanizing agent, the conditions for heat curing of the binder can be at 150° C. to 160° C. for 30 min to 2 hr, and the conditions for re-heat treatment can be at 170° C. to 200° C., in particular, 180° C. to 200° C., for 30 min to 2 hr. The heat curing and the re-heating of the binder may be continuously performed. Alternatively, the elastic layer after the heat curing of the binder may be air-cooled and then be re-heated.

The ratio of the length of the long axis to the length of the short axis (the length of the long axis/the length of the short axis) of the flat hollow particle 4 can be adjusted by controlling the conditions of the re-heating. An increase in the temperature of re-heat treatment or an increase in the time of re-heat treatment enhances the contraction of the binder and accordingly enlarges the ratio of the length of the long axis to the length of the short axis (the length of the long axis/the length of the short axis) of the flat hollow particle 4.

Figure 7:
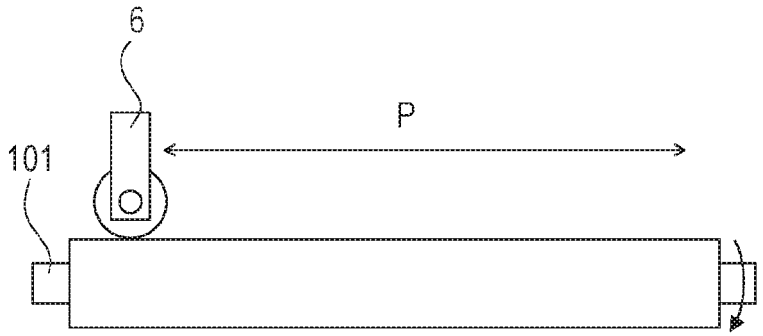
FIG. 7 is a schematic diagram of a pressurized rotating heater.

In another method for forming the flat hollow particles 4 other than the above-described re-heat treatment, for example, the mandrel 1 and the materials of an elastic layer are integrally extruded with an extruder equipped with a crosshead, and heat curing is then performed while the resulting roller being rotated in a state of being pressure contacted to a pressure contact member (hereinafter, referred to as "pressurized heating treatment"). In this method, since the roller is pressurized during the curing, the thermally expandable microcapsule becomes into a flat shape, without expanding into a spherical form. FIG. 7 is a schematic diagram of a pressurized rotating heater that can be used in the pressurized heating treatment according to an embodiment. A pressure contact member 6 including a rotatable pressurizing roller is brought into pressure contact with the roller 101 prepared by integral extrusion of a mandrel and materials of an elastic layer at a prescribed pressurization load. The pressure contact member 6 can move in the longitudinal direction P of the roller 101 at a prescribed moving speed. The pressurized rotating heater can freely change the pressurization load between the center of the roller 101 and each end of the roller 101, execution time, and heating temperature. The roller 101 can be heated by being placed in a hot air furnace in a desired atmosphere. Alternatively, the roller 101 can be heated with a heater disposed in the pressure contact member 6. The heating conditions may be any relatively mild heating conditions that can cause curing of the binder and expansion of the thermally expandable microcapsules in a competitive manner, as in those for heat curing in the re-heat treatment.

In the pressurized heating treatment, the roller is pressurized from the surface of the roller, and the slopes θ1 and θ2 are near 90°.

In the re-heat treatment and the pressurized heating treatment, the surface of the elastic layer after heat curing may be polished for adjusting the shape. In a case of using the roller for electrophotography as a charging roller, the outer diameter at the center of the charging roller can be larger than those at the ends, such that the nip width between the charging roller and the photosensitive member is uniform in the longitudinal direction of the mandrel 1 of the charging roller. Accordingly, the surface of the elastic layer after the heat curing may be polished to adjust the charging roller to a desired shape. The polishing can be performed by cylinder polishing or tape polishing. Examples of the machine for the cylinder polishing include traverse type NC cylinder polishing machines and plunge cut type NC cylinder polishing machines. Since the polishing after re-heat treatment grinds the flat hollow particles 4 in the vicinity of the surface, polishing should be performed after heat curing.

Figure 6:
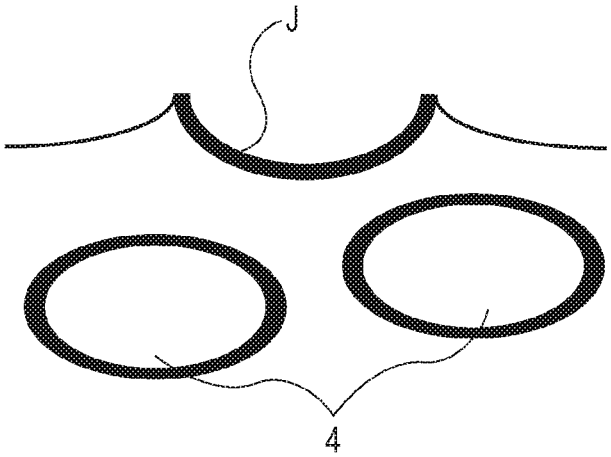
FIG. 6 is a schematic diagram of a bowl-shaped resin particle.

As shown in FIG. 6, the polishing of the surface of the elastic layer can form a bowl-shaped resin particle J having an opening exposing to the surface of the elastic layer. This bowl-shaped resin particle J is formed by partially grinding a hollow particle present in the vicinity of the surface of the elastic layer. Since the amount of deformation of the bowl-shaped resin particle J when compressed by the contact with another member is larger than that of a hollow particle, the rate of attenuating vibration in the roller for electrophotography is high to provide a good effect of preventing the vibration. Consequently, the roller for electrophotography should have the bowl-shaped resin particles J.

The thickness of the elastic layer 2 can be appropriately adjusted depending on the use of the roller for electrophotography. In particular, the thickness can be 1 mm or more and 10 mm or less.

(Surface Layer)

The surface of the elastic layer 2 can be optionally provided with a surface layer 3. Examples of the material for the surface layer 3 include resins, natural rubbers, and synthetic rubbers. The resin may be a thermosetting resin or a thermoplastic resin. In particular, the resin can be a fluororesin, polyamide resin, acrylic resin, polyurethane resin, silicone resin, or butyral resin, which can easily control the viscosity of a coating solution. These resins may be used alone or in a combination of two or more thereof or may be used as a copolymer.

The surface layer 3 may contain a conductive agent for adjusting the electric resistance of the roller for electrophotography. The volume resistivity of the surface layer 3 can be adjusted with an ion conductive agent or an electron conductive agent.

Examples of the ion conductive agent include inorganic ionic materials, such as lithium perchlorate, sodium perchlorate, and calcium perchlorate; cationic surfactants, such as lauryl trimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethylammonium ethosulfate; amphoteric ionic surfactants, such as lauryl betaine, stearyl betaine, and dimethylalkyl lauryl betaine; quaternary ammonium salts, such as tetraethylammonium perchlorate, tetrabutylammonium perchlorate, and trimethyloctadecylammonium perchlorate; and organic acid lithium salts, such as lithium trifluoromethanesulfonate. These ionic conductive agents may be used alone or in a combination of two or more thereof.

Examples of the electron conductive agent include fine particles or fibers of metals such as aluminum, palladium, iron, copper, and silver; conductive metal oxides, such as titanium oxide, tin oxide, and zinc oxide; composite particles composed of the above-mentioned metal fine particles, metal fibers, or metal oxides subjected to surface treatment, such as electrolytic treatment, spray coating, or mixing/shaking; and powders of carbon, such as furnace black, thermal black, acetylene black, Ketjen black, polyacrylonitrile (PAN) carbon, and Pitch carbon.

The surface layer 3 can contain other particles in a range that does not impair the effects of the present invention. Such particles can be insulating particles. Examples of the insulating particles include particles of polyamide resins, silicone resins, fluororesins, (meth)acrylic resins, styrene resin, phenol resins, polyester resins, melamine resins, urethane resins, olefin resins, epoxy resins, and copolymers, modified products, and derivatives thereof; rubbers, such as ethylene-propylene-diene copolymers (EPDM), styrene-butadiene copolymer rubber (SBR), silicone rubber, urethane rubber, isoprene rubber (IR), butyl rubber, acrylonitrile-butadiene copolymer rubber (NBR), chloroprene rubber (CR), and epichlorohydrin rubber; and polyolefin thermoplastic elastomers, urethane thermoplastic elastomers, polystyrene thermoplastic elastomers, fluororubber thermoplastic elastomers, polyester thermoplastic elastomers, polyamide thermoplastic elastomers, polybutadiene thermoplastic elastomers, ethylene-vinyl acetate thermoplastic elastomers, polyvinyl chloride thermoplastic elastomers, and chlorinated polyethylene thermoplastic elastomers. Among these materials, in particular, (meth)acrylic resins, styrene resins, urethane resins, fluororesins, and silicone resins can be used.

These materials constituting the surface layer 3 can be dispersed with a known disperser using beads, such as a sand mill, paint shaker, a dyno mill, or a pearl mill. The resulting dispersion can be applied by any method. Dipping is easy to operate.

As described above, since the flat hollow particles 4 present in the vicinity of the surface of the elastic layer 2 prevent sympathetic vibration and convert the vibrational energy to another energy, the effect of preventing vibration increases with a decrease in the distance of the flat hollow particles 4 from the surface being in contact with another member in the roller for electrophotography. Accordingly, the roller for electrophotography should have the elastic layer 2 as the outermost layer without having any surface layer 3.

<Image-Forming Apparatus>

Figure 8:
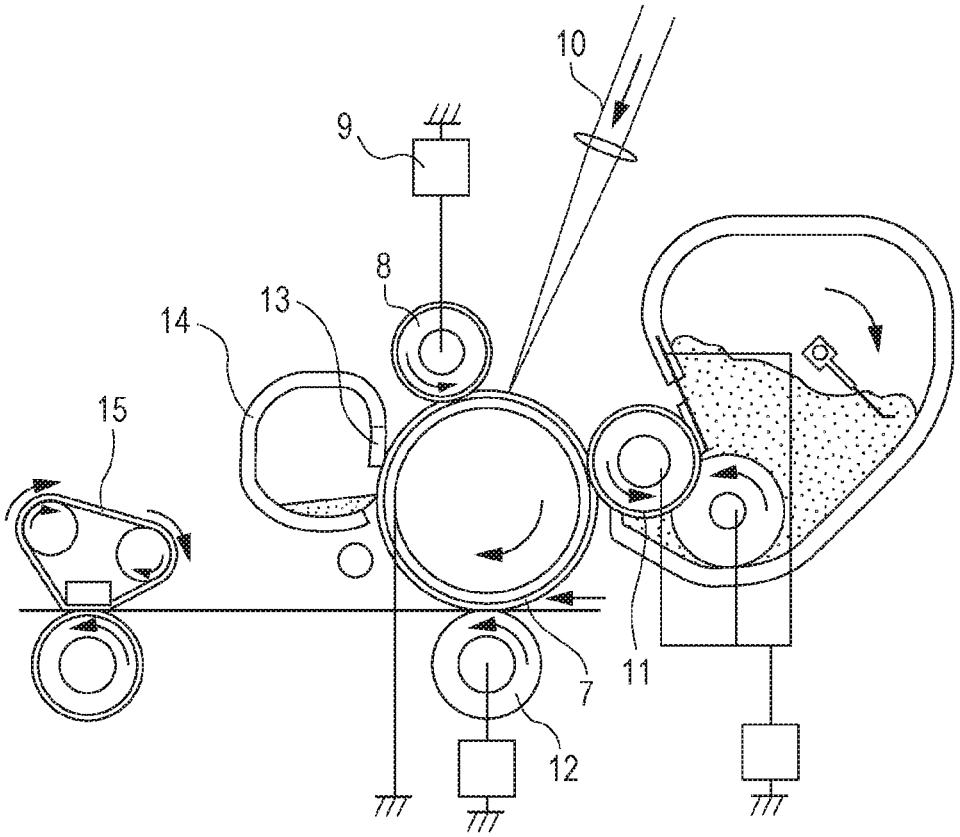
FIG. 8 is a schematic cross-sectional view of an exemplary electrophotographic image-forming apparatus according to an embodiment of the present invention.

FIG. 8 is a schematic cross-sectional view of an exemplary image-forming apparatus including the roller for electrophotography according to an embodiment of the present invention.

In FIG. 8, the image-forming apparatus includes an electrophotographic photosensitive member 7, a charging device for charging the electrophotographic photosensitive member 7, a latent image forming device for exposure, a developing device for developing to a toner image, a transfer device for transferring the image to a transfer material, a cleaning device for collecting the untransferred toner remaining on the electrophotographic photosensitive member 7, and a fixing device for fixing the toner image.

The electrophotographic photosensitive member 7 is a rotating drum including a photosensitive layer on a conductive substrate. The electrophotographic photosensitive member 7 is rotationally driven in the direction indicated by the arrow at a prescribed circumferential velocity (process speed).

The charging device includes a contact-type charging roller 8 being in contact with the electrophotographic photosensitive member 7 with a prescribed pressing force. The charging roller 8 rotates following the rotation of the electrophotographic photosensitive member 7. The electrophotographic photosensitive member 7 is charged to a prescribed potential by applying a prescribed DC voltage from a charging power supply 9 to the charging roller 8.

The latent image forming device (not shown) for forming electrostatic latent images on the electrophotographic photosensitive member 7 is an exposure device such as a laser beam scanner. The latent image forming device irradiates the uniformly charged electrophotographic photosensitive member 7 with exposure light 10 corresponding to image information to form an electrostatic latent image.

The developing device includes a developing sleeve 11 (or developing roller 11) arranged in proximity to or in contact with the electrophotographic photosensitive member 7. The developing sleeve 11 develops an electrostatic latent image through reversal development using a toner electrostatically treated to have the same polarity as the charge polarity of the electrophotographic photosensitive member 7 to form a toner image on the electrophotographic photosensitive member 7.

The transfer device includes a contact type transfer roller 12. The transfer roller 12 transfers a toner image from the electrophotographic photosensitive member 7 to a transfer material such as plain paper. The transfer material is transferred to a sheet feeding system (not shown) having a conveyance member.

The cleaning device includes a blade type cleaning member 13 and a collecting container 14. The cleaning device mechanically scrapes the untransferred toner remaining on the electrophotographic photosensitive member 7 to collect the toner after transfer of the toner image to a transfer material.

The cleaning device may be omitted by employing a simultaneous developing and cleaning system collecting the untransferred toner with a developing device.

The fixing roller 15 is constituted of a heated roller and fixes the transferred toner image on the transfer material and discharges the transfer material to the outside of the device.

In the image-forming apparatus, the above-described roller for electrophotography can be appropriately used as the charging roller 8.

<Process Cartridge>

Figure 9:
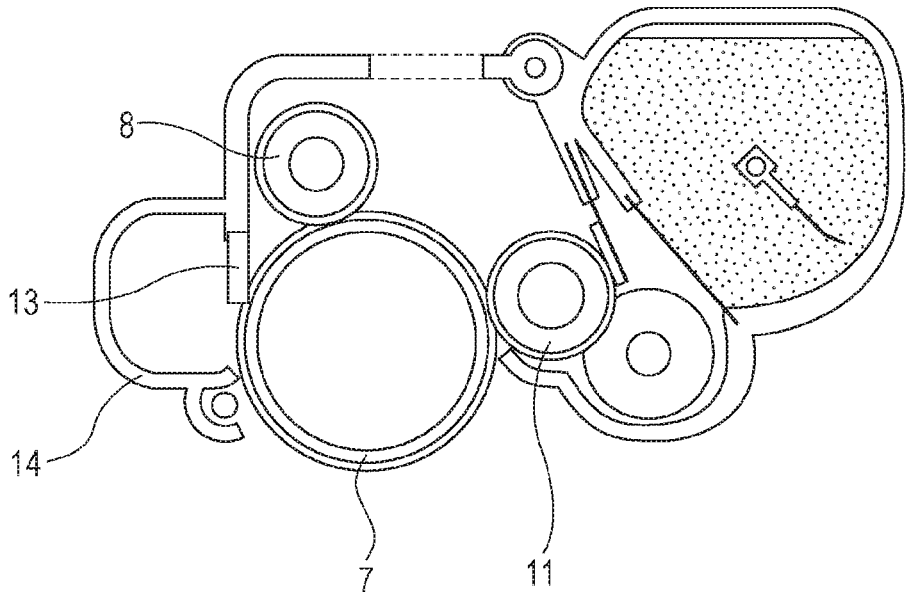
FIG. 9 is a schematic cross-sectional view of an exemplary process cartridge according to an embodiment of the present invention.

FIG. 9 schematically illustrates the structure of an exemplary process cartridge according to an embodiment of the present invention. The process cartridge is composed of unified photosensitive member 7, charging roller 8, developing roller 11, and cleaning member 13 and is constituted to be detachable from an image-forming apparatus. The process cartridge includes the roller for electrophotography according to the above-described embodiment of the present invention. Such a roller for electrophotography can be particularly used as a charging roller 8. The process cartridge including the roller for electrophotography as a charging roller may not necessarily include the cleaning member 13 and the developing roller 11.

As described above, according to an embodiment of the present invention, a roller for electrophotography forming images while preventing horizontal streaks due to stick-slip from occurring is provided. According to other embodiments of the present invention, a process cartridge and an image-forming apparatus that can form high-quality electrophotographic images are provided.

EXAMPLES

Aspects of the present invention will now be described in further detail by way of examples. The present invention is, however, not limited to the following examples.

<Production of Resin Particles (Thermally Expandable Microcapsules)>

[Resin Particle No. 1]

Deionized water (4000 parts by mass) was mixed with colloidal silica (9 parts by mass) and polyvinylpyrrolidone (0.15 parts by mass) as dispersion stabilizers to prepare an aqueous mixture solution. Separately, acrylonitrile (50 parts by mass), methacrylonitrile (45 parts by mass), and methyl methacrylate (5 parts by mass) as polymerizable monomers were mixed with n-hexane (12.5 parts by mass) as an internal material and dicumyl peroxide (0.75 parts by mass) as a polymerization initiator to prepare an oily mixture solution. The oily mixture solution was added to the aqueous mixture solution, and sodium hydroxide (0.4 parts by mass) was further added to the mixture to prepare a dispersion.

The resulting dispersion was mixed with stirring with a homogenizer for 3 min and was then charged in a polymerization reaction vessel purged with nitrogen, followed by a reaction at 60° C. for 20 hr with stirring at 400 rpm. The resulting reaction product repeatedly filtered and rinsed with water and was dried at 80° C. for 5 hr to produce resin particles. The resin particles were crushed and classified with a sonic classifier to prepare resin particle No. 1.

[Resin Particle No. 2]

Resin particle No. 2 was produced as in resin particle No. 1 except that the conditions for classification were modified.

[Measurement of Volume-Average Particle Diameter of Resin Particles]

The volume-average particle diameters of the resulting resin particle Nos. 1 and 2 were measured with a laser diffraction particle size distribution analyzer (trade name: Coulter LS 230, manufactured by Beckman Coulter, Inc.).

The measurement used water module and used pure water as a measurement solvent. The inside of the measuring system of the particle size distribution analyzer was rinsed with pure water for about 5 min, and 10 to 25 mg of sodium sulfite as an antifoaming agent was added to the inside of the measuring system, followed by execution of a background function. Separately, three or four drops of a surfactant were added to 50 mL of pure water, and 1 to 25 mg of resin particles were further added thereto to prepare an aqueous solution suspending the resin particles. The aqueous solution was subjected to dispersion treatment with an ultrasonic distributor for 1 to 3 min to prepare a test sample solution. The test sample solution was gradually added to the inside of the measuring system of the particle size distribution analyzer, and the concentration of the test sample in the measuring system was adjusted such that the value measured by polarization intensity differential scattering (PIDS) on the display of the apparatus was 45% or more and 55% or less and was subjected to measurement. The volume-average particle diameter was calculated from the resulting volume-based particle size distribution.

The volume-average particle diameters of resin particle Nos. 1 and 2 were 30 μm and 15 μm, respectively.

<Production of Elastic Layer Material>

[Elastic Layer Material No. 1]

Four components shown below were added to 100 parts by mass of acrylonitrile butadiene rubber (NBR) (trade name: N230SV, manufactured by JSR Corporation), and the mixture was kneaded with an enclosed mixer adjusted to 50° C. for 15 min.

Carbon black (trade name: Tokablack #7360SB, manufactured by Tokai Carbon Co., Ltd.): 48 parts by mass;

Zinc oxide (trade name: Zinc Oxide type 2, manufactured by Sakai Chemical Industry Co., Ltd.): 5 parts by mass;

Zinc stearate (trade name: SZ-2000, manufactured by Sakai Chemical Industry Co., Ltd.): 1 part by mass; and Calcium carbonate (trade name: Nanox #30, manufactured by Maruo Calcium Co., Ltd.): 20 parts by mass.

To the mixture were added resin particle No. 1 (12 parts by mass), sulfur (1.2 parts by mass) as a vulcanizing agent, and tetrabenzylthiuram disulfide (TBzTD) (4.5 parts by mass, trade name: Perkacit TBzTD, manufactured by Flexsys N.V.) as a vulcanization accelerator. The mixture was then kneaded with a two-roll mill cooled to 25° C. for 10 min to give elastic layer material No. 1.

[Elastic Layer Material No. 2]

Elastic layer material No. 2 was produced as in elastic layer material No. 1 except that resin particle No. 2 (4 parts by mass) was used as the resin particles.

[Elastic Layer Material No. 3]

Five components shown below were added to 100 parts by mass of styrene butadiene rubber (SBR) (trade name: Tafuden 2003, manufactured by Asahi Kasei Corporation), and the mixture was kneaded with an enclosed mixer adjusted to 80° C. for 15 min.

Zinc oxide (trade name: Zinc Oxide type 2, manufactured by Sakai Chemical Industry Co., Ltd.): 5 parts by mass;

Zinc stearate (trade name: SZ-2000, manufactured by Sakai Chemical Industry Co., Ltd.): 1 part by mass;

Carbon black (trade name: Ketjen black EC600JD, manufactured by Lion Corporation): 8 parts by mass;

Carbon black (trade name: Seast 5, manufactured by Tokai Carbon Co., Ltd.): 40 parts by mass; and Calcium carbonate (trade name: Nanox #30, manufactured by Maruo Calcium Co., Ltd.): 15 parts by mass.

To the mixture were added resin particle No. 1 (12 parts by mass), sulfur (1 part by mass) as a vulcanizing agent, and dibenzothiazyl sulfide (DM) (1 part by mass, trade name: Nocceler TS, manufactured by Ouchi Shinko Chemical Industrial Co., Ltd.) and tetramethylthiuram monosulfide (TS) (1 part by mass, trade name: Nocceler TS, manufactured by Ouchi Shinko Chemical Industrial Co., Ltd.) as vulcanization accelerators. The mixture was then kneaded with a two-roll mill cooled to 25° C. for 10 min to give elastic layer material No. 3.

[Elastic Layer Material No. 4]

Elastic layer material No. 4 was produced as in elastic layer material No. 3 except that resin particle No. 2 (4 parts by mass) was used as the resin particles.

[Elastic Layer Material No. 5]

Elastic layer material No. 5 was produced as in elastic layer material No. 1 except that azodicarbonamide (15 parts by mass, trade name: Unifoam AZ, manufactured by Otsuka Chemical Co., Ltd.) was additionally used as a chemical foaming agent.

Example 1

Production of Roller for Electrophotography No. 1

A thermosetting resin containing 10% by mass of carbon black was applied onto a stainless steel substrate having a diameter of 6 mm and a length of 252.5 mm and was dried to prepare a mandrel.

The cylindrical surface of the mandrel was coated with the elastic layer material No. 1 with an extrusion molding machine equipped with a crosshead using the mandrel as the central axis. The thickness of elastic layer material No. 1 was adjusted to 1.75 mm.

The roller after extrusion was heated in an air-heating furnace at 160° C. for 1 hr to vulcanize the layer of the elastic layer material No. 1 to form an elastic layer. The ends of the elastic layer were then removed to adjust the length to 224.2 mm.

The outer peripheral surface of the resulting roller was polished with a plunge cut type cylinder polishing machine to adjust the thickness of the elastic layer to 1.5 mm. A vitrified grinding stone was used as the grinding stone, and green silicon carbide (GC) having a grain size of 100 mesh was used as the abrasive grain. The rotation speed of the roller was 350 rpm, the rotation speed of the polishing grinding stone was 2050 rpm, cutting speed was 20 mm/min, and the spark-out time (the time at cutting of 0 mm) was 0 sec. This roller had a crown quantity (the difference in the outer diameter between the center and a position 90 mm from the center) of 120 μm.

After the polishing, the roller was re-heated in an air-heating furnace at 200° C. for 1 hr to give a roller for electrophotography No. 1.

The resulting roller for electrophotography No. 1 was subjected to the following measurement and evaluation. The results of measurement and evaluation are shown in Table 2.

Bowl-shaped resin particles having exposed openings were present in the surface of the elastic layer, and hollow particles were present in the region deeper than a depth of 100 μm from the surface.

[Flat Hollow Particle]

The roller for electrophotography No. 1 was three-dimensionally measured with an X-ray CT system (trade name: TUX-3200N, manufactured by Tohken Co., Ltd.) to output a file of a 3D-CAD solid model. Then, assuming that the hollow particles was a solid particle, the weight centroid of the solid particle was determined from the resulting 3D-CAD solid model with 3D-CAD (trade name: NX, manufactured by Siemens PLM Software Inc.). Subsequently, the roller for electrophotography No. 1 was equally divided into ten in the longitudinal direction. In each region of the resulting ten regions, a region of a 5 mm square at a depth of 100 μm from the surface of the elastic layer was selected as an observation region at each of four points (0°, 90°, 180°, and 270°) in the circumferential direction. The depth from the surface of the elastic layer was determined by measuring the heights of convexes in a 5 mm square region of the surface of the elastic layer, calculating the average height thereof, and using the average height as the reference (depth: 0 μm). One hollow particle was selected from the particles present in the observation region and was cut by a first plane perpendicular to the axis direction (longitudinal direction) of the mandrel and passing through the point of the hollow particle or a second plane containing the axis of the mandrel and passing through the point of the hollow particle. Whether the hollow particle satisfies the condition (i) in the first plane or not and whether the hollow particle satisfies the condition (ii) in the second plane or not were verified. This verification was performed for all hollow particles present in the observation region, and the number of flat hollow particles satisfying the conditions (i) and (ii) was determined. Furthermore, all observation regions (40 regions in total: ten in the longitudinal direction×four in the circumferential direction) were verified for the presence of flat hollow particles satisfying the conditions (i) and (ii). Hollow particles lying both the region from the surface to a depth of 100 μm and the region deeper than a depth of 100 μm from the surface were also included in the verification.

[Verification of Shell of Hollow Particle]

Regarding the hollow particles that were determined as flat hollow particles satisfying the conditions (i) and (ii) by the verification of the three-dimensional images, the cross-section of each hollow particle was observed with an SEM to verify whether the hollow particle has a shell or not. A section of the elastic layer of the roller for electrophotography No. 1 was cutout with a cutter such that cross-sections of the hollow particles could be observed. The cross-section of each hollow particle was photographed at a magnification of ×1000 at an accelerating voltage of 3.0 kV using an SEM (trade name: S-4800, manufactured by Hitachi High-Technologies Corp.). The photographed image demonstrated that the shell of the hollow particle (the resin that had been in a form of the thermally expandable microcapsule) was present with a thickness. This verification was performed for all of the hollow particles that were determined as flat hollow particles satisfying the conditions (i) and (ii). The results demonstrated that all observation regions (40 regions in total: ten in the longitudinal direction×four in the circumferential direction) contained flat hollow particles having shells.

[Slope of Line Extending in the Long Axis Direction of Hollow Particle]

Regarding each of the hollow particles that were determined as flat hollow particles satisfying the conditions (i) and (ii) by the verification of the three-dimensional images, in the first plane, the slope of the line extending in the long axis direction of the flat hollow particle with respect to the line passing through the rotation center of the mandrel and the point of the flat hollow particle was determined from the 3D-CAD. Similarly, in the second plane, the slope of the line extending in the long axis direction with respect to the line passing through the point of the flat hollow particle and perpendicular to the axis of the mandrel was determined from the 3D-CAD. The arithmetic means of the slopes of all flat hollow particles satisfying the conditions (i) and (ii) were defined as slope θ1 for the first plane and slope θ2 for the second plane. The results of the evaluation are shown in Table 2.

[Ratio of the Length of Long Axis to the Length of Short Axis of Hollow Particle]

Regarding each of the hollow particles that were determined as flat hollow particles satisfying the conditions (i) and (ii) by the verification of the three-dimensional images, the lengths of the long axis and the short axis in each of the first plane and the second plane were determined from 3D-CAD. The ratio of the arithmetic mean a1 of the length of the long axis to the arithmetic mean b1 of the length of the short axis in the first plane, a1/b1 (the length of the long axis/the length of the short axis), was determined. Similarly, the ratio of the arithmetic mean a2 of the length of the long axis to the arithmetic mean b2 of the length of the short axis in the second plane, a2/b2 (the length of the long axis/the length of the short axis), was determined. The results of the evaluation are shown in Table 2.

[Vibration of Roller for Electrophotography]

A monochrome laser printer (trade name: LBP6700, manufactured by CANON KABUSHIKI KAISHA), an image-forming apparatus having the structure shown in FIG. 8, and its process cartridge were prepared. The accessory charging roller was detached from the process cartridge, and the roller for electrophotography No. 1 was attached to the process cartridge as the charging roller. The charging roller was brought into contact with the photosensitive member with a spring at a pressing pressure of 4.9 N for one end, 9.8 N in total for both ends. The monochrome laser printer was modified such that the process speed was 370 mm/sec, and a voltage was applied to the charging roller from the outside. The applied voltage was an AC voltage; the peak-to-peak voltage (Vpp) was 1800 V; the frequency (f) was 1350 Hz; and the DC voltage (Vdc) was −600 V.

The magnification of vibration (amplitude) of the charging roller rotating following the rotation of the photosensitive member was measured with a laser Doppler vibrometer (trade name: LV-1710, manufactured by Ono Sokki Co., Ltd.). The position of the measurement was at the center in the longitudinal direction of the charging roller on the opposite side to the position in contact with the photosensitive member. The vibration during the operation of the monochrome laser printer was measured. The frequency analysis demonstrated that the amplitude of 2700 Hz was the maximum. Accordingly, the magnification (amplitude) of the vibration of 2700 Hz was determined as the magnification of the charging roller. The results of the evaluation are shown in Table 3.

[Rate of Elastic Recovery of Elastic Layer]

Figure 10:
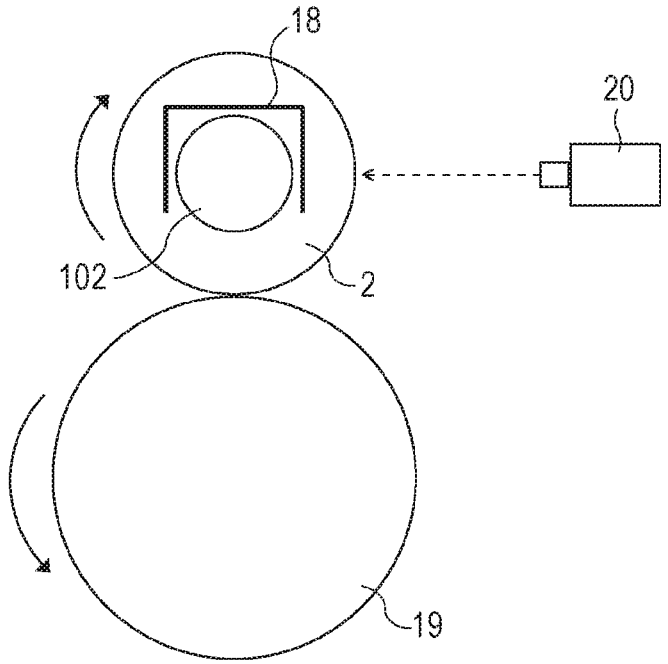
FIG. 10 is a schematic view of an apparatus for measuring the amount of deformation of a roller for electrophotography.
Figure 11:
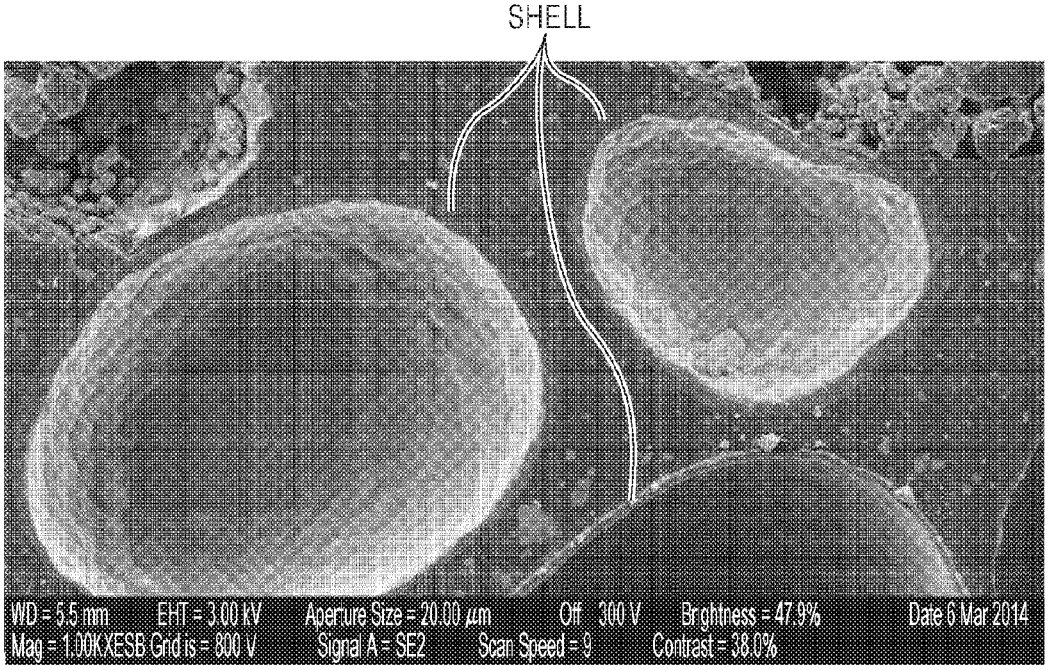
FIG. 11 is an image of SEM observation of flat hollow particles.

The rate of elastic recovery of the elastic layer was evaluated by the difference in the outer diameter between before and during the rotation (the amount of deformation). The measurement was performed with the apparatus shown in FIG. 10 by measuring the amount of deformation of the roller for electrophotography. In the measurement, the roller for electrophotography No. 1 and the measurement apparatus were placed in an environment of a temperature of 23° C. and a relative humidity of 50% for 24 hr or more in advance.

Specifically, the amount of deformation of the roller for electrophotography was measured as follows. A load of 4.9 N was applied to each end of the mandrel 1 with a shaft bearing 18 such that the roller for electrophotography 102 was brought into contact with a columnar metal roller 19 having a diameter 30 mm in parallel. A laser displacement meter 20 (trade name: LK-H085, manufactured by Keyence Corporation) was set at a position rotated by 270° in the rotational direction R from the center of the nip portion formed by the roller for electrophotography 102 and the columnar metal roller 19 such that the surface of the roller for electrophotography 102 was irradiated with laser light. Before the rotation of the roller for electrophotography 102, the distance between the laser displacement meter 20 and the surface of the roller for electrophotography 102 was measured. Subsequently, the columnar metal roller 19 was rotated at a circumferential velocity of 370 mm/sec with a motor (not shown). After 3 min from the start of driven rotation of the roller for electrophotography 102, the distance between the laser displacement meter 20 and the surface of the roller for electrophotography 102 was measured as in above. The difference in the distance between the laser displacement meter 20 and the surface of the roller for electrophotography 102 between before and during the rotation was defined as the amount of deformation. The results of the evaluation are shown in Table 3.

[Evaluation of Image of Roller for Electrophotography]

The monochrome laser printer (trade name: LBP6700, manufactured by CANON KABUSHIKI KAISHA) used in the measurement of vibration and a process cartridge having the roller for electrophotography No. 1 as the charging roller were placed in an environment of a temperature of 23° C. and a relative humidity of 50% for 24 hr, and images were evaluated as follows.

Specifically, a half-tone image (image of horizontal lines each having a width of one dot at intervals of two dots in the direction perpendicular to the rotational direction of the photosensitive member) was output. The resulting image was visually evaluated based on the following criteria for spots and horizontal streaks in the image. The results of the evaluation are shown in Table 3.

Evaluation on Horizontal Streak in Image

Rank A: Image showing no horizontal streak defect;

Rank B: Image slightly showing a horizontal streak defect;

Rank C: Image showing a horizontal streak defect in a partial region; and

Rank D: Image prominently showing a horizontal streak defect in a broad range.

Evaluation on Spot in Image

Rank A: Image showing no spot defect;

Rank B: Image slightly showing a spot defect;

Rank C: Image showing a spot defect in a partial region; and

Rank D: Image prominently showing a spot defect in a broad range.

Examples 2 to 10

Rollers for electrophotography Nos. 2 to 10 were produced as in Example 1 except that the elastic layer material and the temperature of re-heat treatment were those shown in Table 1. Tables 2 and 3 show the results of measurement and evaluation of the rollers for electrophotography Nos. 2 to 10.

Examples 11 and 12

Rollers for electrophotography Nos. 11 and 12 were produced as in Example 1 except that the elastic layer material was a mixture of elastic layer material No. 1 and elastic layer material No. 3 at a mass ratio of 1:1 and that the temperatures of re-heat treatment were those shown in Table 1.

Tables 2 and 3 show the results of measurement and evaluation of the rollers for electrophotography Nos. 11 and 12.

Example 13 [Production of Coating Solution for Surface Layer]

An ϵ-caprolactone-modified acrylic polyol solution (trade name: Placcel DC2016, manufactured by Daicel Corporation) was diluted with methyl isobutyl ketone (MIBK) such that the solid content was 19% by mass. This diluted solution (526.3 parts by mass, acrylic polyol solid content: 100 parts by mass) was mixed with carbon black (45 parts by mass, trade name: MA100, manufactured by Mitsubishi Chemical Corporation), a modified dimethyl silicone oil (0.08 parts by mass, trade name: SH28PA, manufactured by Dow Corning Toray Co., Ltd.), and a block isocyanate mixture (80.14 parts by mass). The block isocyanate mixture was a mixture of hexamethylene diisocyanate (trade name: Duranate TPA-B80E, manufactured by Asahi Kasei Corporation) and isophorone diisocyanate (trade name: Vestanat B1370, manufactured by Degussa-Huls AG) at a ratio of 7:3.

Glass beads (200 g) having an average particle diameter of 0.8 mm were dispersed in the mixture solution (dispersion medium, 200 g) prepared above in a 450-mL glass bottle with a paint shaker dispersing machine for 100 hr. After the dispersion, the glass beads were removed to give a coating solution for surface layer.

[Application of Coating Solution for Surface Layer]

The coating solution for surface layer was applied onto the outer peripheral surface of an elastic layer, prepared as in Example 1, by dipping. The dipping time was 9 sec, and the lifting speed was linearly changed with time from an initial speed of 20 mm/s to a final speed of 2 mm/s.

The resulting coated product was air-dried at room temperature for 30 min or more and was then heated at 80° C. for 1 hr and further at 160° C. for 1 hr with a hot air circulation dryer to give a roller for electrophotography No. 13.

Tables 2 and 3 show the results of measurement and evaluation of the roller for electrophotography No. 13.

Example 14

Roller for electrophotography No. 14 was produced as in Example 13 except that the elastic layer material and the temperature of re-heat treatment were those shown in Table 1. Tables 2 and 3 show the results of measurement and evaluation of the roller for electrophotography No. 14.

Example 15

A thermosetting resin containing 10% by mass of carbon black was applied onto a stainless steel substrate having a diameter of 6 mm and a length of 252.5 mm and was dried to prepare a mandrel.

The cylindrical surface of the mandrel was coated with the elastic layer material No. 2 with an extrusion molding machine equipped with a crosshead using the mandrel as the central axis. The thickness of elastic layer material No. 2 was adjusted to 1.75 mm.

The roller after extrusion was heated to cure the layer of the elastic layer material No. 2 while being rotated with a pressurized rotating heater as shown in FIG. 7. The pressurized heating conditions were set that the pressurization load was 2.94 N (300 gf), the moving speed of the pressure contact member 6 was 0.4 mm/sec, the temperature of the pressurized surface was 160° C., and the rotation speed of the roller was 90 rpm. The roller after the pressurized rotating heating was vulcanized in an air-heating furnace at 160° C. for 1 hr. The ends of the elastic layer were then removed to adjust the length to 224.2 mm to form a roller for electrophotography No. 15.

Since the surface of the roller for electrophotography No. 15 was not polished, no bowl-shaped resin particles having exposed openings were present in the surface of the elastic layer. Tables 2 and 3 show the results of measurement and evaluation of the roller for electrophotography No. 15.

Examples 16 to 22

Rollers for electrophotography Nos. 16 to 22 were produced as in Example 15 except that the elastic layer material and the temperature of re-heat treatment were those shown in Table 1. Tables 2 and 3 show the results of measurement and evaluation of the rollers for electrophotography Nos. 16 to 22.

Comparative Example 1

Elastic layer material No. 5 was produced as in elastic layer material No. 1 except that 15 parts by mass of azodicarbonamide (trade name: Unifoam AZ, manufactured by Otsuka Chemical Co., Ltd.) was used as a chemical foaming agent instead of the resin particle No. 1.

Roller for electrophotography No. 23 was produced as in Example 1 except that the elastic layer material No. 5 was used as the elastic layer material.

Tables 2 and 3 show the results of measurement and evaluation of the roller for electrophotography No. 23.

Comparative Example 2

Roller for electrophotography No. 24 was produced as in Example 19 except that the pressurization load was that shown in Table 1. Tables 2 and 3 show the results of measurement and evaluation of the roller for electrophotography No. 24.

TABLE 1

| | Elastic layer material No. | Process of production | Temperature of re-heating treatment (° C.) | Pressurization load (gf) | Bowl-shaped resin particle | Surface layer |
|---|---|---|---|---|---|---|
| Example 1 | 1 | Re-heating | 200 | — | exist | not exist |
| Example 2 | 1 | Re-heating | 180 | — | exist | not exist |
| Example 3 | 1 | Re-heating | 170 | — | exist | not exist |
| Example 4 | 2 | Re-heating | 200 | — | exist | not exist |
| Example 5 | 2 | Re-heating | 170 | — | exist | not exist |
| Example 6 | 3 | Re-heating | 200 | — | exist | not exist |
| Example 7 | 3 | Re-heating | 170 | — | exist | not exist |
| Example 8 | 4 | Re-heating | 200 | — | exist | not exist |
| Example 9 | 4 | Re-heating | 180 | — | exist | not exist |
| Example 10 | 4 | Re-heating | 170 | — | exist | not exist |
| Example 11 | 1 and 3 | Re-heating | 200 | — | exist | not exist |
| Example 12 | 1 and 3 | Re-heating | 170 | — | exist | not exist |
| Example 13 | 1 | Re-heating | 200 | — | exist | exist |
| Example 14 | 1 | Re-heating | 170 | — | exist | exist |
| Example 15 | 2 | Pressurized heating | — | 300 | not exist | not exist |
| Example 16 | 2 | Pressurized heating | — | 250 | not exist | not exist |
| Example 17 | 2 | Pressurized heating | — | 200 | not exist | not exist |
| Example 18 | 2 | Pressurized heating | — | 180 | not exist | not exist |
| Example 19 | 4 | Pressurized heating | — | 300 | not exist | not exist |
| Example 20 | 4 | Pressurized heating | — | 250 | not exist | not exist |
| Example 21 | 4 | Pressurized heating | — | 200 | not exist | not exist |
| Example 22 | 4 | Pressurized heating | — | 180 | not exist | not exist |
| Comparative Example 1 | 5 | Re-heating | 200 | — | exist | not exist |
| Comparative Example 2 | 4 | Pressurized heating | — | 170 | not exist | not exist |

TABLE 2

| | | | First cross-section | | | | Second cross-section | | | |
|---|---|---|---|---|---|---|---|---|---|---|
| | Number of flat hollow particles | Shell of hollow particle | a1 (μm) | b1 (μm) | a1/b1 | θ1 (°) | a2 (μm) | b2 (μm) | a2/b2 | θ2 (°) |
| Example 1 | multiple | exist | 60.2 | 31.7 | 1.9 | 88 | 60.8 | 32.0 | 1.9 | 88 |
| Example 2 | multiple | exist | 52.8 | 35.2 | 1.5 | 88 | 52.2 | 34.8 | 1.5 | 87 |
| Example 3 | multiple | exist | 49.0 | 37.7 | 1.3 | 87 | 48.9 | 37.6 | 1.3 | 87 |
| Example 4 | multiple | exist | 40.5 | 21.3 | 1.9 | 88 | 40.7 | 21.4 | 1.9 | 88 |
| Example 5 | multiple | exist | 26.7 | 20.5 | 1.3 | 88 | 26.9 | 20.7 | 1.3 | 87 |
| Example 6 | multiple | exist | 59.5 | 31.3 | 1.9 | 41 | 59.3 | 37.1 | 1.6 | 50 |
| Example 7 | multiple | exist | 49.9 | 38.4 | 1.3 | 61 | 49.6 | 41.3 | 1.2 | 69 |
| Example 8 | multiple | exist | 40.7 | 21.4 | 1.9 | 40 | 40.3 | 25.2 | 1.6 | 50 |
| Example 9 | multiple | exist | 31.5 | 21.0 | 1.5 | 45 | 31.2 | 24.0 | 1.3 | 58 |
| Example 10 | multiple | exist | 27.0 | 20.8 | 1.3 | 60 | 27.0 | 20.8 | 1.3 | 69 |
| Example 11 | multiple | exist | 59.7 | 31.4 | 1.9 | 65 | 61.9 | 34.4 | 1.8 | 69 |
| Example 12 | multiple | exist | 49.8 | 38.3 | 1.3 | 74 | 51.1 | 39.3 | 1.3 | 78 |
| Example 13 | multiple | exist | 60.4 | 31.8 | 1.9 | 88 | 60.8 | 32.0 | 1.9 | 88 |
| Example 14 | multiple | exist | 49.4 | 38.0 | 1.3 | 87 | 49.1 | 37.8 | 1.3 | 87 |
| Example 15 | multiple | exist | 39.9 | 21.0 | 1.9 | 89 | 39.5 | 20.8 | 1.9 | 89 |
| Example 16 | multiple | exist | 31.1 | 20.7 | 1.5 | 88 | 31.4 | 20.9 | 1.5 | 88 |
| Example 17 | multiple | exist | 26.7 | 20.5 | 1.3 | 88 | 26.9 | 20.7 | 1.3 | 89 |
| Example 18 | multiple | exist | 24.2 | 20.2 | 1.2 | 89 | 24.0 | 20.0 | 1.2 | 88 |
| Example 19 | multiple | exist | 39.5 | 20.8 | 1.9 | 88 | 39.0 | 20.5 | 1.9 | 88 |
| Example 20 | multiple | exist | 30.9 | 20.6 | 1.5 | 88 | 31.1 | 20.7 | 1.5 | 88 |
| Example 21 | multiple | exist | 26.5 | 20.4 | 1.3 | 89 | 26.7 | 20.5 | 1.3 | 89 |
| Example 22 | multiple | exist | 24.1 | 20.1 | 1.2 | 89 | 24.0 | 20.0 | 1.2 | 89 |
| Comparative Example 1 | — | not exist | 58.2 | 52.9 | 1.1 | 44 | 58.3 | 53.0 | 1.1 | 88 |
| Comparative Example 2 | multiple | exist | 23.0 | 20.9 | 1.1 | 89 | 22.9 | 20.8 | 1.1 | 88 |

TABLE 3

| | Magnification of vibration (nm) | Amount of deformation (μm) | Horizontal streak in image | Spot in image |
|---|---|---|---|---|
| Example 1 | 5 | 5 | A | A |
| Example 2 | 5 | 7 | A | A |
| Example 3 | 9 | 10 | B | B |
| Example 4 | 5 | 9 | A | A |
| Example 5 | 10 | 12 | B | B |

TABLE 3-continued

| | Magnification of vibration (nm) | Amount of deformation (μm) | Horizontal streak in image | Spot in image |
|---|---|---|---|---|
| Example 6 | 12 | 5 | C | A |
| Exomple 7 | 9 | 10 | B | B |
| Example 8 | 12 | 7 | C | A |
| Example 9 | 9 | 9 | B | A |
| Example 10 | 11 | 12 | B | B |

TABLE 3-continued

| | Magnification of vibration (nm) | Amount of deformation (μm) | Horizontal streak in image | Spot in image |
|---|---|---|---|---|
| Example 11 | 11 | 6 | B | A |
| Example 12 | 11 | 11 | B | B |
| Example 13 | 8 | 5 | A | A |
| Example 14 | 9 | 10 | B | B |
| Example 15 | 7 | 7 | A | A |
| Example 16 | 7 | 9 | A | A |
| Example 17 | 11 | 12 | B | B |
| Example 18 | 13 | 16 | C | C |
| Example 19 | 8 | 7 | A | A |
| Example 20 | 6 | 9 | A | A |
| Example 21 | 11 | 12 | B | B |
| Example 22 | 13 | 16 | C | C |
| Comparative Example 1 | 28 | 43 | D | D |
| Comparative Example 2 | 22 | 20 | D | C |

The rollers for electrophotography according to Examples 1 to 22 included flat hollow particles 4 satisfying conditions (i) and (ii) in the vicinities of the surfaces of the elastic layers and thereby caused less vibration and gave good results in evaluation of horizontal streaks in images. Since the flat hollow particles 4 satisfying the conditions (i) and (ii) were resin balloons having shells, the amount of deformation in high-speed rotation was small (a high rate of elastic recovery), and the evaluation of images also gave good results.

In contrast, since the roller for electrophotography No. 23 according to Comparative Example 1 was a foamed roller not containing hollow particles, the vibration and the amount of deformation of the roller for electrophotography were large, and the evaluation of horizontal streak and spot of images did not give good results. In the roller for electrophotography No. 24 according to Comparative Example 2, since the ratio of the length of the long axis to the length of the short axis (the length of the long axis/the length of the short axis) of the hollow particles was small, the vibration was large.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-077015 filed on Apr. 3, 2015, Application No. 2015-077053 filed on Apr. 3, 2015, and Application No. 2015-134770 filed on Jul. 3, 2015, which are hereby incorporated by reference herein in their entirety.

What is claimed is:

1. A roller for electrophotography comprising a mandrel; and an elastic layer on the mandrel, wherein the elastic layer contains hollow particles in a region from a surface of the elastic layer to a depth of 100 μm, wherein each of the hollow particles satisfying conditions (i) and (ii):

(i) when the roller for electrophotography is intersected by a first plane perpendicular to an axial direction of the mandrel, and passing through a point inside each of the hollow particles, the point corresponding to, when assuming that each of the hollow particles is a solid particle, a centroid of the solid particle, each of the hollow particles has a flat cross-sectional shape having a long axis and a short axis, and a line passing through the point of each of the hollow particles and a rotation center of the mandrel in the first plane and a line extending in the long axis direction having an intersection point, (ii) when the roller for electrophotography is intersected by a second plane containing the axis of the mandrel and passing through the point of each of the hollow particles, each of the hollow particles has a flat cross-sectional shape having a long axis and a short axis, and a line passing through the point of each of the hollow particles and perpendicular to the axis of the mandrel and a line along the long axis of each of the hollow particles have an intersection point;

the cross-section of each of the hollow particles intersected by the first plane has a ratio of the length of the long axis to the length of the short axis of 1.2 or more and 1.9 or less; and the cross-section of each of the hollow particles intersected by the second plane has a ratio of the length of the long axis to the length of the short axis of 1.2 or more and 1.9 or less.

2. The roller for electrophotography according to claim 1, wherein each of the hollow particles satisfying the conditions (i) and (ii) further satisfies the following conditions:

in the first plane, the slope of the line extending in the long axis direction of each of the hollow particles with respect to the line passing through the rotation center of the mandrel and the point of each of the hollow particles is 45° or more and 90° or less; and in the second plane, the slope of the line extending in the long axis direction of each of the hollow particles with respect to the line passing through the point of each of the hollow particles and perpendicular to the axis of the mandrel is 45° or more and 90° or less.

3. The roller for electrophotography according to claim 2, wherein each of the hollow particles satisfying the conditions (i) and (ii) further satisfies the following conditions:

in the first plane, the line along the long axis is perpendicular to the line passing through the point of each of the hollow particles and a rotation center of the mandrel;

in the second plane, the line along the long axis is perpendicular to a line passing through the point of each of the hollow particles and perpendicular to the axis of the mandrel.

4. The roller for electrophotography according to claim 1, wherein each of the hollow particles satisfying the conditions (i) and (ii) has a ratio of the length of the long axis to the length of the short axis (the length of the long axis/the length of the short axis) of 1.3 or more and 1.9 or less in the first plane, and has a ratio of the length of the long axis to the length of the short axis (the length of the long axis/the length of the short axis) of 1.3 or more and 1.9 or less in the second plane.

5. The roller for electrophotography according to claim 1, wherein the elastic layer contains a binder being acrylonitrile butadiene rubber (NBR) or styrene butadiene rubber (SBR).

6. The roller for electrophotography according to claim 1, wherein a number of the hollow particles satisfying the conditions (i) and (ii), per unit volume (100×100×100 μm) in the region is 5 or more and 150 or less.

7. The roller for electrophotography according to claim 1, wherein the length of the short axis of each of the hollow particles satisfying the conditions (i) and (ii) in the first plane is 10 μm or more and 130 μm or less; and the length of the short axis of each of the hollow particles satisfying the conditions (i) and (ii) in the second plane is 10 μm or more and 130 μm or less.

8. The roller for electrophotography according to claim 1, further containing a hollow particle in a region of the elastic layer deeper than a depth of 100 μm from the surface of the elastic layer.

9. A process cartridge detachable from an image-forming apparatus, comprising the roller for electrophotography according to claim 1.

10. An image-forming apparatus comprising a roller for electrophotography, wherein the roller for electrophotography includes a mandrel and an elastic layer on the mandrel; and the elastic layer contains hollow particles in a region from a surface of the elastic layer to a depth of 100 μm, each of the hollow particles satisfying conditions (i) and (ii):

(i) when the roller for electrophotography is intersected by a first plane perpendicular to an axial direction of the mandrel and passing through a point inside of each of the hollow particles, the point corresponding to, when assuming that each of the hollow particles is a solid particle, a centroid of the solid particle, each of the hollow particles has a flat cross-sectional shape having a long axis and a short axis, and a line passing through the point of each of the hollow particles and a rotation center of the mandrel in the first plane and a line extending in the long axis direction have an intersection point, (ii) when the roller for electrophotography is intersected by a second plane containing the axis of the mandrel and passing through the point of each of the hollow particles, each of the hollow particles has a flat cross-sectional shape having a long axis and a short axis, and a line passing through the point of each of the hollow particles and perpendicular to the axis of the mandrel and a line along the long axis of each of the hollow particles have an intersection point, the cross-section of each of the hollow particles intersected by the first plane has a ratio of the length of the long axis to the length of the short axis of 1.2 or more and 1.9 or less, and the cross-section of each of the hollow particles intersected by the second plane has a ratio of the length of the long axis to the length of the short axis of 1.2 or more and 1.9 or less.

* * * * *